US008062149B2

(12) United States Patent
Ban

(10) Patent No.: US 8,062,149 B2
(45) **Date of Patent: *Nov. 22, 2011**

(54) GOLF CLUB HEAD

(75) Inventor: Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/725,071

(22) Filed: Mar. 16, 2010

(65) Prior Publication Data

US 2010/0261544 A1 Oct. 14, 2010

(30) Foreign Application Priority Data

Apr. 8, 2009 (JP) ..... 2009-094351

(51) Int. Cl.
*A63B 53/04* (2006.01)

(52) U.S. Cl. ..... 473/330; 473/331

(58) Field of Classification Search ..... 473/324–350, 473/287–292

See application file for complete search history.

(56) References Cited

U.S. PATENT DOCUMENTS

| | | | | |
|---|---|---|---|---|
| 5,029,864 | A | 7/1991 | Keener | |
| 5,618,239 | A | 4/1997 | Rife | |
| 5,755,626 | A | 5/1998 | Shira | |
| 5,766,087 | A | 6/1998 | Kawamatsu | |
| 5,785,610 | A | 7/1998 | Birmingham | |
| 6,183,379 | B1 | 2/2001 | Kim et al. | |
| 6,814,673 | B2 * | 11/2004 | Wahl et al. | 473/331 |
| 7,014,568 | B2 | 3/2006 | Pelz | |
| 7,056,226 | B2 * | 6/2006 | Kennedy | 473/330 |
| 7,273,422 | B2 | 9/2007 | Vokey et al. | |
| 7,568,983 | B2 | 8/2009 | Gilbert | |
| 7,780,548 | B2 * | 8/2010 | Solheim | 473/330 |
| 7,824,279 | B2 * | 11/2010 | Ban et al. | 473/331 |
| 7,905,797 | B2 * | 3/2011 | Gilbert et al. | 473/287 |
| 2002/0049095 | A1 | 4/2002 | Galloway et al. | |
| 2005/0130761 | A1 | 6/2005 | Vokey et al. | |
| 2008/0045351 | A1 | 2/2008 | Vokey et al. | |
| 2008/0171613 | A1 | 7/2008 | Gilbert et al. | |
| 2010/0056295 | A1 * | 3/2010 | Ban et al. | 473/331 |
| 2010/0317459 | A1 * | 12/2010 | Ban | 473/331 |

FOREIGN PATENT DOCUMENTS

| | | | |
|---|---|---|---|
| JP | 10-248974 | A | 9/1998 |
| JP | 2005-169129 | A | 6/2005 |

* cited by examiner

*Primary Examiner* — Sebastiano Passaniti
(74) *Attorney, Agent, or Firm* — Sughrue Mion, PLLC

(57) ABSTRACT

This invention provides a golf club head comprising a plurality of score lines formed in its face. Letting θ be the angle of the side wall of the scoreline with respect to the face, Cp be the center point of a virtual circle which has a radius of 0.254 mm and is inscribed in both the side wall and the face, F be the point of contact between the virtual circle and the face, G be the point of contact between the virtual circle and the side wall, P be a point farthest from the center point Cp in the segment from the point of contact F to the point of contact G in the edge portion of the scoreline, and D (mm) be the length from the center point Cp to the point P, the golf club head satisfies 56°≦θ≦80° and 0.270≦D≦0.287.

6 Claims, 6 Drawing Sheets

FIG. 6

| | LENGTH D (mm) | BACK SPIN AMOUNT | SCRATCH |
|---|---|---|---|
| #1 | 0.262 | E | A |
| #2 | 0.266 | D | A |
| #3 | 0.270 | C | B |
| #4 | 0.274 | B | B |
| #5 | 0.278 | B | B |
| #6 | 0.282 | A | C |
| #7 | 0.287 | A | C |
| #8 | 0.290 | A | D |

GOLF CLUB HEAD

BACKGROUND OF THE INVENTION

1. Field of the Invention

The present invention relates to a golf club head and, more particularly, to scorelines in the face.

2. Description of the Related Art

In general, a plurality of linear grooves are formed in the face of a golf club head so as to run parallel to each other in the toe-to-heel direction (see, for example, Japanese Patent Laid-Open Nos. 10-248974 and 2005-169129). These grooves are called, for example, scorelines, marking lines, or face lines (these grooves will be referred to as scorelines in this specification). These scorelines have the effect of increasing the amount of backspin on a struck golf ball, or suppressing a significant decrease in the amount of backspin on a struck golf ball upon a shot in rainy weather or that from the rough.

A rule concerning the scorelines of an athletic golf club head stipulates that the edge of a scoreline must fall within a virtual circle which has a radius of 0.011 inches and is concentric with a virtual circle which has a radius of 0.010 inches and is inscribed in both the side wall of the scoreline and the face (to be referred to as the "two-circle rule" hereinafter). This two-circle rule admits, as an exception, a scoreline which has its edge falling outside a virtual circle with a radius of 0.011 inches but which satisfies the condition in which the included angle between two segments which connect the center of the virtual circle and two intersections between the virtual circle and the contour of the edge of the scoreline falling outside the virtual circle is 10° or less (to be referred to as the "maximum angle rule" hereinafter). However, the edge of the scoreline is prohibited from projecting in excess of 0.0113 inches (0.287 mm) from the center of the virtual circle (to be referred to as the "maximum projection rule" hereinafter).

To satisfy the two-circle rule, it is basically inevitable to set a relatively narrow angle of the side wall of a scoreline with respect to the face. This decreases the amount of spin on a struck golf ball. Conversely, when the angle of the side wall of a scoreline with respect to the face is set relatively wide, this leads to violation of the two-circle rule unless a measure involved is taken.

SUMMARY OF THE INVENTION

It is an object of the present invention to provide a golf club head which can obtain a larger amount of spin while it conforms to the two-circle rule.

According to the present invention, there is provided a golf club head comprising a plurality of scorelines formed in a face thereof, wherein letting θ be an angle of a side wall of the scoreline with respect to the face, Cp be a center point of a virtual circle which has a radius of 0.254 mm and is inscribed in both the side wall and the face, F be a point of contact between the virtual circle and the face, G be a point of contact between the virtual circle and the side wall, P be a point farthest from the center point Cp in a segment from the point of contact F to the point of contact G in an edge portion of the scoreline, and D (mm) be a length from the center point Cp to the point P, the golf club head satisfies $56° \leqq \theta \leqq 80°$ and $0.270 \leqq D \leqq 0.287$.

Further features of the present invention will become apparent from the following description of exemplary embodiments with reference to the attached drawings.

BRIEF DESCRIPTION OF THE DRAWINGS

FIG. 6 is a table showing the result of test shots;

DESCRIPTION OF THE EMBODIMENTS

Figure 1:
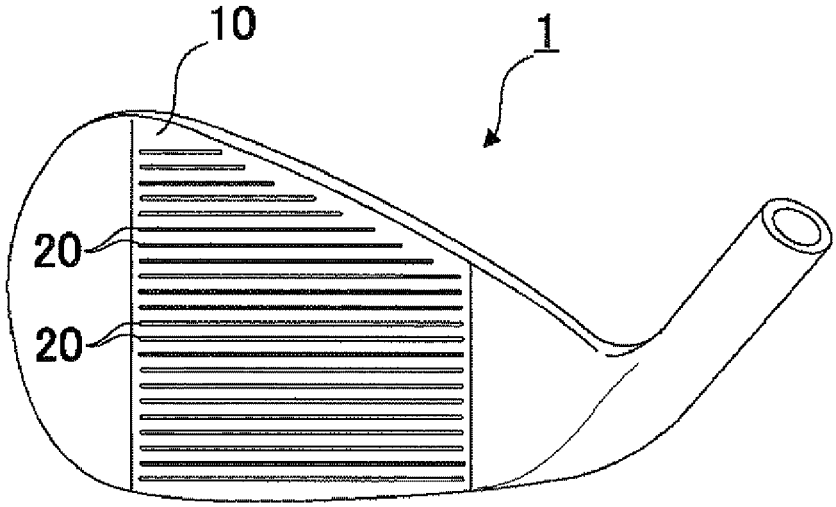
FIG. 1 is a perspective view of a golf club head 1 according to one embodiment of the present invention.

FIG. 1 is a perspective view of a golf club head 1 according to one embodiment of the present invention. FIG. 1 exemplifies a case in which the present invention is applied to an iron type golf club head. The present invention is suitable for an iron type golf club head and, more particularly, for middle iron, short iron, and wedge type golf club heads. More specifically, the present invention is suitable for a golf club head with a loft angle of 25° (inclusive) to 70° (inclusive) and a head weight of 200 g (inclusive) to 320 g (inclusive). However, the present invention is also applicable to wood type and utility type golf club heads.

The golf club head 1 has a plurality of scorelines 20 formed in its face (its striking surface or striking face) 10. The scorelines 20 are linear grooves running parallel to each other in the toe-to-heel direction. Although the scorelines 20 run at equal intervals (equal pitches) in this embodiment, they may run at different intervals.

Figure 2:
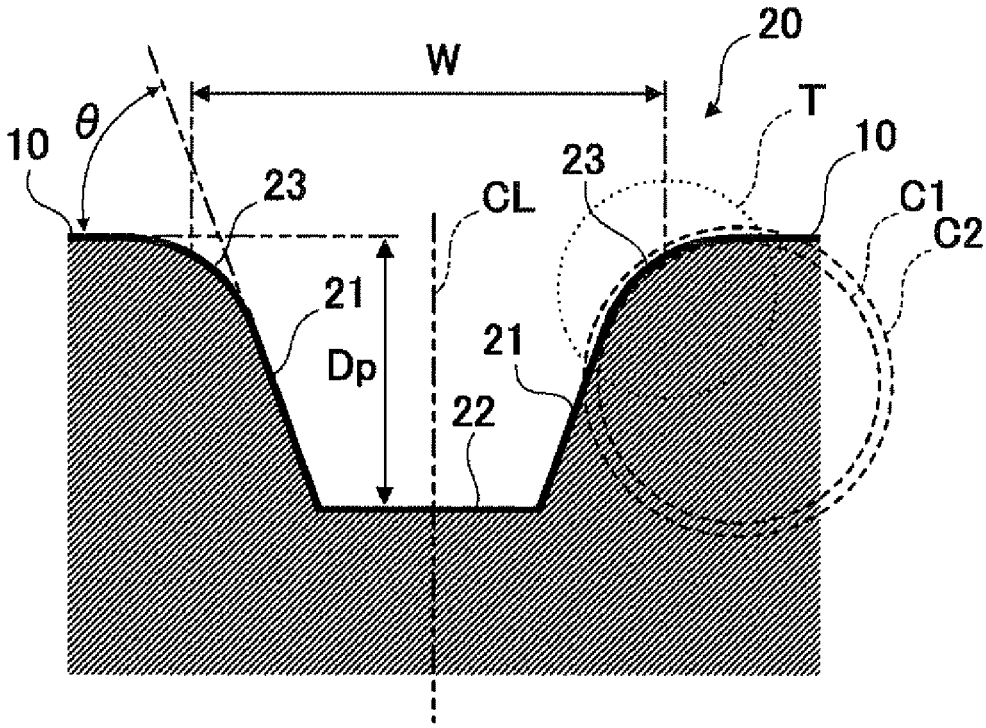
FIG. 2 is a sectional view of a scoreline 20 in a direction perpendicular to its longitudinal direction (toe-to-heel direction)

FIG. 2 is a sectional view of the scoreline 20 in a direction perpendicular to its longitudinal direction (toe-to-heel direction). In this embodiment, the cross-sectional shapes of the scoreline 20 are the same in its portions other than its two end portions (its toe-side end portion and heel-side end portion). In addition, the cross-sectional shapes of the scorelines 20 are the same.

The scoreline 20 has a pair of side walls 21 and a bottom wall 22. Note that a structure in which the lower ends of the pair of side walls 21 are directly continuous with each other without the bottom wall 22 between them is also adoptable. The cross-sectional shape of the scoreline 20 is bilaterally symmetrical about its center line CL. A width W is of the scoreline 20 and is measured by the so-called 30 degrees measurement rule of athletic golf clubs. A depth Dp is the distance from the face 10 to the bottom wall 22 and is 0.020 inches (0.508 mm) or less.

A virtual circle C1 is a circle which has a radius of 0.010 inches (0.254 mm) and is inscribed in both the side wall 21 and the face 10. A virtual circle C2 is a circle which has a radius of 0.011 inches and is concentric with the virtual circle C1. An angle θ is of the side wall 21 with respect to the face 10. To make the golf club head 1 conform to the above-mentioned two-circle rule, an edge portion 23 (the boundary portion between the face 10 and the side wall 21) needs to fall within the virtual circle C2. In this embodiment, the edge portion 23 falls within the virtual circle C2.

Figure 3:
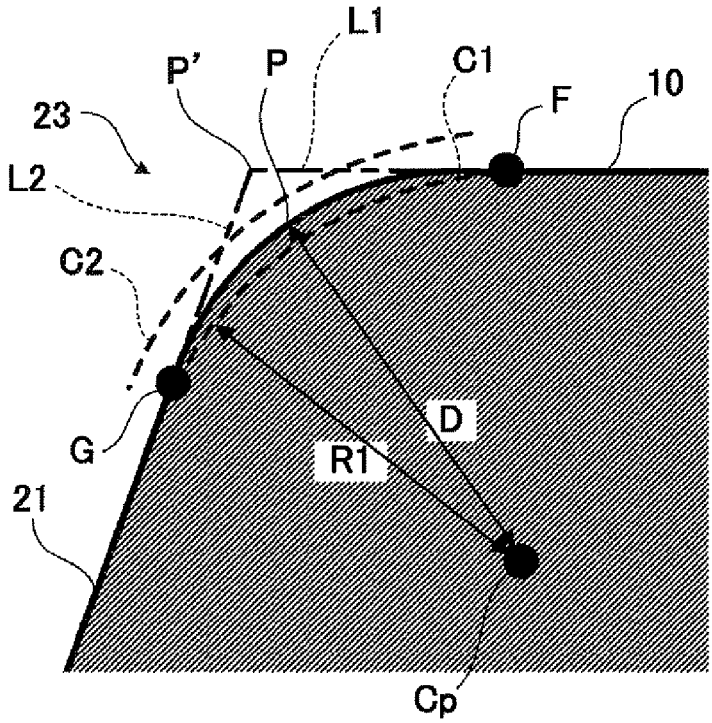
FIG. 3 is an enlarged view of a portion corresponding to a circle T in FIG. 2.

FIG. 3 is an enlarged view of a portion corresponding to a circle T in FIG. 2 and is, more specifically, an enlarged sectional view of the edge portion 23 of the scoreline 20. In this embodiment, the edge portion 23 is rounded off so as to have an arcuated contour. Note that a center point Cp is of the virtual circle C1 (and the virtual circle C2), a point of contact G is between the side wall 21 and the virtual circle C1, and a point of contact F is between the face 10 and the virtual circle C1. A line L1 is a virtual extension line of the face 10, and a line L2 is a virtual extension line of the side wall 21. A point P lies on the contour of the edge portion 23 of the scoreline 20 and is farthest from the center point Cp in the segment from the point of contact F to the point of contact G. A point P' is the intersection between the lines L1 and L2 and is farthest from the center point Cp unless the edge portion 23 is formed in an arc as in this embodiment. A radius R1 is of the virtual circle C1 and is 0.010 inches (0.254 mm). A length D is the distance between the center point Cp and the point P.

Assume herein that the edge portion 23 of the scoreline 20 has the contour indicated by the lines L1 and L2 instead of being rounded off as in this embodiment. Using the angle θ in FIG. 2, the distance (mm) between the center point Cp and the point P' is given by $0.254/\cos(\theta/2)$. Due to a geometrical constraint involved, if the angle θ is 56° or more, the distance between the center point Cp and the point P' exceeds 0.0113 inches, and this may lead to violation of the two-circle rule. On the other hand, if the angle θ is less than 56°, the spin amount on a struck golf ball may decrease drastically.

Under the circumstance, in this embodiment, the angle θ shown in FIG. 2 is 56° or more and $0.270\ \text{mm} \leqq D \leqq 0.287\ \text{mm}$. If $D > 0.287$ mm, the scoreline 20 violates the two-circle rule due to factors associated with the above-mentioned maximum projection rule. If $D < 0.270$ mm, a sufficient spin amount may not be obtained. Note that, when the edge portion 23 partially falls outside the virtual circle C2, it is adjusted so as to satisfy the above-mentioned maximum angle rule.

When the angle θ exceeds 80°, the scoreline 20 is not always easy to shape in respect of processes involved. Again, when the angle θ exceeds 80°, the golf club head 1 is prone to scratch a golf ball. For these reasons, the angle θ is 56° (inclusive) to 80° (inclusive).

Figure 4:
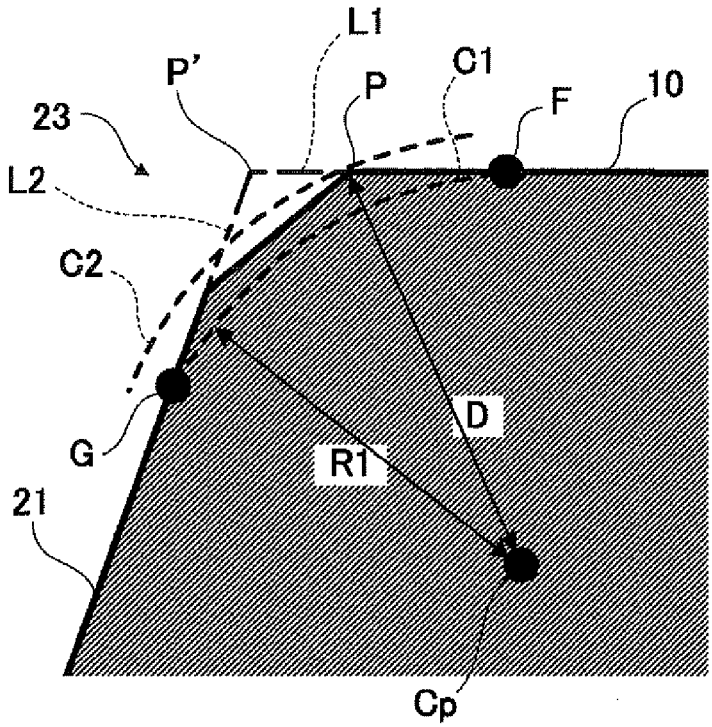
FIG. 4 is a view illustrating another example of an edge portion 23.

Although the contour shape of the edge portion 23 is an arc in the example illustrated in FIG. 3, it is not limited to this. In the example illustrated in FIG. 4, the edge portion 23 has a linear contour and serves as a flat surface tilted with respect to both the face 10 and the side wall 21 of the scoreline 20. Or again, the edge portion 23 may have, for example, a stepped contour.

Figure 7:
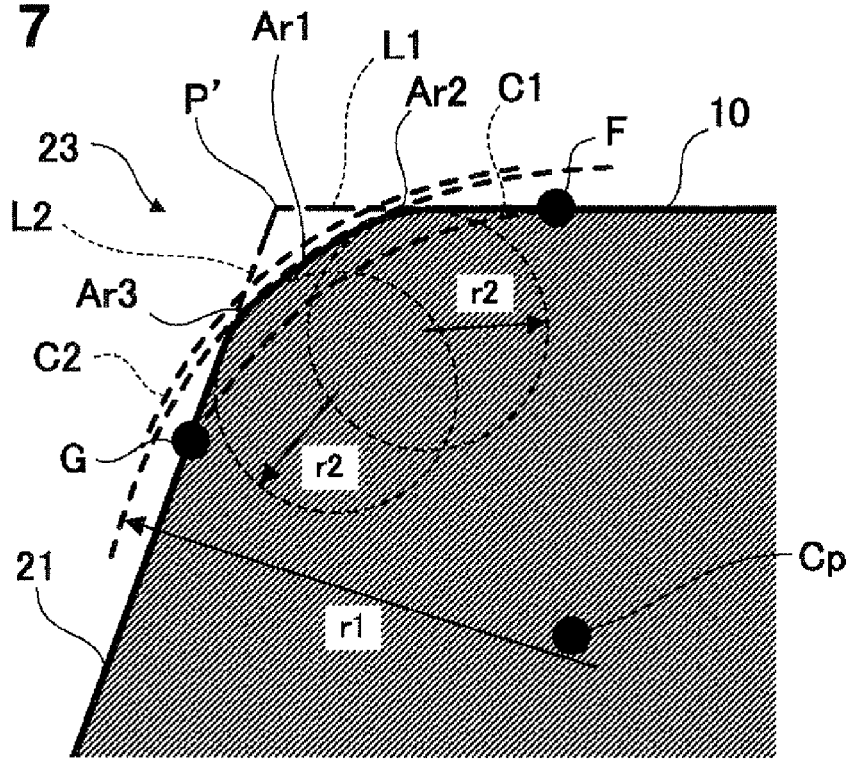
FIG. 7 is a view illustrating another example of the edge portion 23.

Further, for example, the contour of the edge portion 23 can also be a circular arc with a modified radius. The example shown in FIG. 7 illustrates an exemplary edge 23, the contour of which has a plurality of circular arcs having different radii. The circular arc Ar1 has a radius of r1, where as circular arcs Ar2 and Ar3 have radii of r2 that is smaller than r1. The radius r1 is larger than 0.011 inches. In the example shown in FIG. 7, the radii of circular arcs Ar2 and Ar3 are identical, but they may be different.

Figure 8:
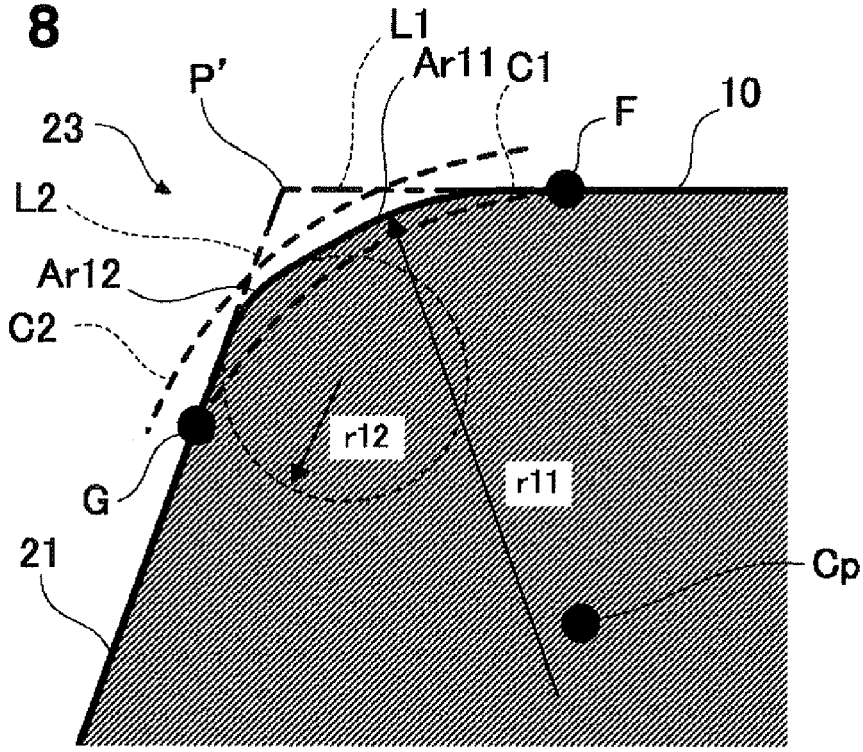
FIG. 8 is a view illustrating another example of the edge portion 23.

The example shown in FIG. 8 also illustrates the edge portion 23 whose contour is formed by connecting a plurality of circular arcs each having different radii. Circular arc Ar11 has a radius of r11, and the radius r12 of circular arc Ar12 is smaller than r11. The radius R11 is larger than 0.011 inches.

In the example shown in FIG. 8, although the arc Ar11 having the larger radius is chosen to be placed on the side of the face 10 among the two circular arcs Ar11 and Ar12 having different radii, the reverse arrangement can also be employed wherein the circular arc Ar12 having the smaller radius is on placed the side of the face 10.

Further, the contour of the edge portion 23 is can be a curved contour with a continuously increasing or decreasing circular arc diameter from the side of the contact point G towards the side of the contact point G.

Figure 9:
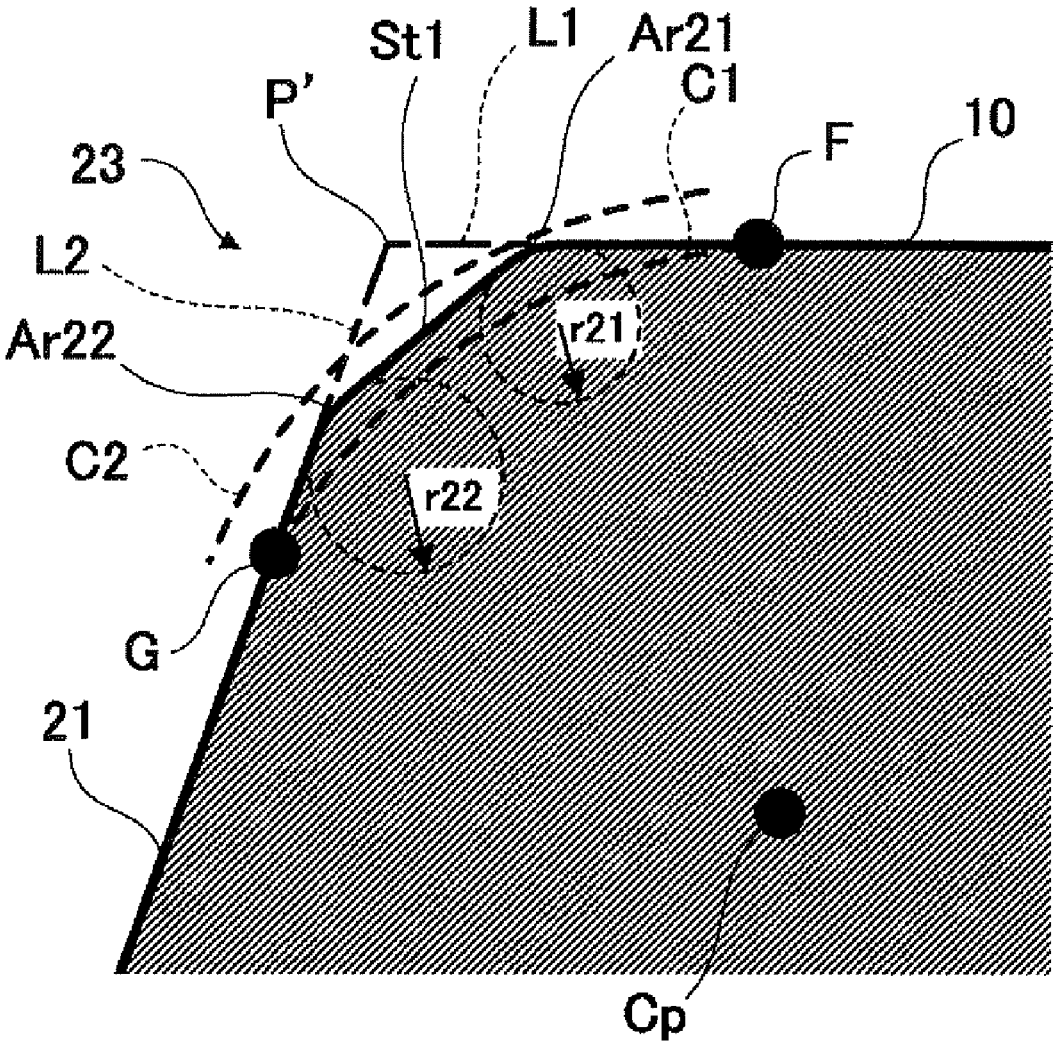
FIG. 9 is a view illustrating another example of the edge portion 23.

Further, for example, the contour of the edge portion 23 may also be formed by connecting circular arcs with straight lines. The example shown in FIG. 9 shows the edge portion 23 whose contour is formed by connecting a straight line portion Sr1 and circular arc Ar21 and Ar22. The circular arc Ar21 connects the straight line portion Sr1 and the face 10, and the circular arc Ar22 connects the straight line portion Sr1 and the side wall 21. The radius of the circular arc Ar21 is r21, and that of the circular arc Ar22 is r22. In the example illustrated in FIG. 9, the two radii r21 and r22 differ, but they may be the same. Further, in the example of FIG. 9, the contour is formed by connecting each of the circular arcs 21 and 22 to each of the two ends of the straight line Sr1, but the contour may also be formed by connecting only one circular arc to one end of the straight line portion Sr1.

In an athletic golf club head, the cross-sectional area of the scoreline 20 and the pitch between adjacent scorelines 20 need to satisfy a rule: Cross-sectional Area A ($\text{inch}^2$)/Pitch (inch)≦0.003. In accordance with the metric system, this rule is rewritten as: Cross-sectional Area A ($\text{mm}^2$)/Pitch (mm) ≦0.0762. When the golf club head 1 is used for an athletic contest, it is designed so as to satisfy this rule.

An example of a method of forming the edge portion 23 shown in FIG. 3 will be explained. First, a component which forms a face 10 is prepared. This component is a face member if a golf club head is formed from a face member and a body member; is a body member if the golf club head is formed from a body member and a sole member; or is a body member if the golf club head is formed from a body member alone. A face and temporary scorelines are formed in the component. Subsequently, any unnecessary portions are eliminated to form an edge portion 23. In this manner, the edge portion 23 can be formed by a two-stage process.

Figure 5:
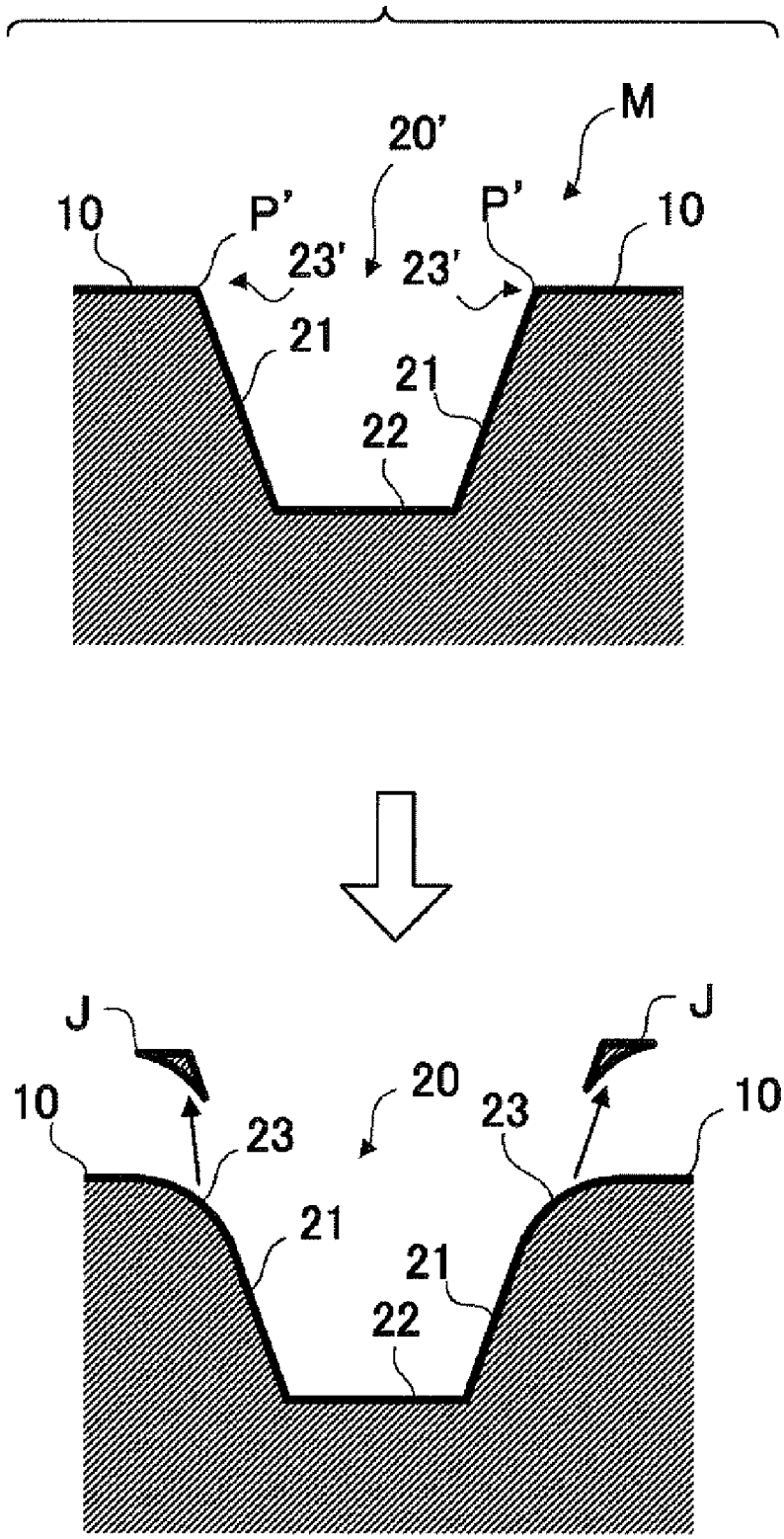
FIG. 5 is a view illustrating an example of a method of forming the edge portion 23.

FIG. 5 is a view illustrating an example of a method of forming the edge portion 23 shown in FIG. 3. A component M has a face 10 and temporary scorelines 20' formed in it. A temporary edge portion 23' has the contour indicated by the lines L1 and L2 shown in FIG. 3. At this stage, since the point P' is farthest from the center point Cp of the virtual circle C1, $D > 0.254/\cos(\theta/2)$. The face 10 and temporary scorelines 20' can be formed by, for example, a cutting process, a forging process, or a casting process.

Next, unnecessary portions J are eliminated to form a final edge portion 23, as shown in FIG. 5. Examples of a method of eliminating the unnecessary portions J are a cutting process, a particle blowing process, or a polishing process. Examples of the particle blowing process are sandblasting, shot blasting, and shot peening. Examples of the polishing process are mechanical polishing, electrolytic polishing, and chemical polishing. The electrolytic process is performed by, for example, dipping the component M in an electrolytic solution in an electrolytic tank, and supplying a DC current to the electrolytic solution while the component M acts as the anode and the electrolytic tank acts as the cathode. At this time, the unnecessary portions J can be more precisely eliminated by setting, for example, counter electrodes along the scorelines 20'. The chemical polishing can be performed by, for example, dipping the component M in a chemical polishing solution containing hydrogen peroxide as a major component or spraying a chemical polishing solution onto the component M.

Although a two-stage process in which the edge portion 23 is formed after the temporary scorelines 20' are formed is adopted in this embodiment, a one-stage process in which they are formed at once can also be adopted.

Example

Eight golf club heads #1 to #8 having scorelines that differ only in length D were fabricated, and test shots took place using golf clubs equipped with the respective golf club heads. Each golf club head was a wedge with a loft angle of 58°. The scorelines of the respective golf club heads all had the cross-sectional shape shown in FIG. 2, a width W of 0.88 mm, a depth Dp of 0.45 mm, an angle θ of 60°, and a pitch of 3.6 mm but had different lengths D. Test shots took place by striking each golf club a plurality of times from a spot spaced apart from the green by 40 yards toward the green. The amounts of backspin on a golf ball were evaluated relatively on a scale of five grades A to E based on the degrees of stop of the golf ball on the green by visual observation. The degrees of scratch on the golf ball were evaluated relatively on a scale of five grades A to E by visual observation as well.

FIG. 6 is a table showing the result of test shots. The lengths D are design values. The amount of backspin and the degree of scratch were graded as A: Very Good, B: Good, C: Average, D: Bad, and E: Very Bad. Grades A to C were determined as acceptable levels from the test player's feelings.

The experimental result shown in FIG. 6 reveals the following facts. As for the amount of backspin, the longer the length D, the better the obtained result becomes. Also, as for the degree of scratch, the longer the length D, the worse the obtained result becomes. From the viewpoint of ensuring a given amount of backspin, the length D needs to be 0.270 mm at the minimum. Since the grade of the amount of backspin is B or higher when the length D is 0.274 mm or more, and is A when the length D is 0.287 mm, the length D is preferably 0.280 mm or more.

At the same time, when the length D exceeds 0.287 mm, the scorelines violate the two-circle rule, as described above, and, worse still, the degree of scratch is grade D (#8). Hence, the length D is 0.270 mm (inclusive) to 0.287 mm (inclusive) and is, preferably, 0.280 mm (inclusive) to 0.287 mm (inclusive).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-094351, filed Apr. 8, 2009, which is hereby incorporated by reference herein in its entirety.

What is claimed is:

1. A golf club head comprising a plurality of scorelines formed in a face thereof, wherein letting θ be an angle of a side wall of the scoreline with respect to the face, Cp be a center point of a virtual circle which has a radius of 0.254 mm and is inscribed in both the side wall and the face, F be a point of contact between the virtual circle and the face, G be a point of contact between the virtual circle and the side wall, P be a point farthest from the center point Cp in a segment from the point of contact F to the point of contact G in an edge portion of the scoreline, and D (mm) be a length from the center point Cp to the point P, the golf club head satisfies:

$$56° \leqq \theta \leqq 80° \text{ and } 0.270 \leqq D \leqq 0.287.$$

2. The head according to claim 1, wherein a final edge portion of the scoreline is formed by temporarily forming the edge portion so as to satisfy $D>0.254/\cos(\theta/2)$, and partially removing the temporarily formed edge portion so as to satisfy $D \leqq 0.287$.

3. The head according to claim 1, wherein the edge portion comprises a flat surface tilted with respect to both the face and the side wall.

4. The head according to claim 3, wherein the point P is a connecting point between the flat surface and the face.

5. The head according to claim 3, wherein the flat surface is formed within the segment.

6. The head according to claim 1, wherein the edge portion comprises a stepped contour.

* * * * *